United States Patent [19]

Erickson et al.

[11] Patent Number: 4,623,859

[45] Date of Patent: Nov. 18, 1986

[54] REMOTE CONTROL CIRCUIT BREAKER

[75] Inventors: Kenneth W. Erickson; John H. Gilliland, both of Lincoln, Nebr.

[73] Assignee: Square D Company, Palatine, Ill.

[21] Appl. No.: 765,402

[22] Filed: Aug. 13, 1985

[51] Int. Cl.[4] ..... H01H 75/00; H01H 77/00; H01H 83/00

[52] U.S. Cl. ..... 335/14; 335/20; 335/71; 74/411; 74/424.7; 74/425; 74/89.14

[58] Field of Search ..... 335/14, 20, 71; 307/35, 307/38, 116; 74/425

[56] References Cited

U.S. PATENT DOCUMENTS

| | | | |
|---|---|---|---|
| 2,902,560 | 9/1959 | Stanback et al. | 335/44 |
| 3,198,908 | 11/1960 | Staak | 335/71 |
| 3,332,043 | 7/1967 | Camp | 335/71 |
| 3,808,905 | 5/1974 | Metzinger | 74/425 |
| 4,276,528 | 6/1981 | Ohara et al. | 335/71 |

*Primary Examiner*—E. A. Goldberg

*Assistant Examiner*—Lincoln D. Donovan

*Attorney, Agent, or Firm*—Mary R. Jankousky; Larry I. Golden; Richard T. Guttman

[57] ABSTRACT

An electric circuit breaker capable of being opened and closed from a remote location. The circuit breaker includes a stationary contact, a movable contact mounted on a carrier and a trip mechanism that trips the circuit breaker, moving the carrier to an open position upon the occurrence of an overcurrent. The remote control assembly opens and closes the circuit breaker independently of the trip mechanism. Upon receiving a signal from a timer switch, a motor operates, rotating a gear spring connected to the motor shaft. An actuator has a tooth positioned between the wire layers of the gear spring. As the gear spring rotates, the tooth moves toward the motor, pivoting the actuator. An operating rod, connected to both the actuator and the carrier, pulls the carrier to open the contacts as the actuator rotates. When the contacts reach the open position, the actuator hits a switch to shut off the motor.

17 Claims, 7 Drawing Figures

REMOTE CONTROL CIRCUIT BREAKER

FIELD OF THE INVENTION

This invention relates to electric circuit breakers and more particularly to an improvement providing for remote opening and closing of circuit breakers.

DESCRIPTION OF PRIOR ART

To reduce the demand for electricity during peak usage hours, local utilities have increased rates during these peak hours. Residential, commercial and industrial users are thus encouraged to shift usage of electricity to non-peak hours. Some users have allowed utilities to temporarily interrupt electrical service during peak hours for certain predetermined non-crucial uses. One example of possible interrupted service is service to a hot water heater during periods of high electricity demand, such as might occur during hot summer days when air conditioners are widely used.

Another use of remote control circuit breakers is for programmable lighting control of industrial locations. The circuit breakers turn office lights on during weekday work hours, keep the lights on low during weekends, and perhaps set the lights at an intermediate level during early evening hours.

To perform these functions a circuit breaker is needed that opens and closes on demand from a remote location. The remote operation should not impede the circuit breaker tripping function.

One remote control circuit breaker presently available utilizes a solenoid that must be continuously energized to hold the circuit breaker in the open position. Continuous energization requires heat dissipation that may disturb the calibration of the heat sensitive element of a thermal circuit breaker. Another remote control circuit breaker using two solenoids requires both a high current supply and relatively large solenoids.

SUMMARY OF THE INVENTION

It is an object of this invention to provide a cost-effective and reliable switching mechanism for remote control load management.

It is a second object of this invention to provide a switching mechanism that requires a small amount of current and a small space within the circuit breaker.

It is a further object of this invention to perform the remote opening and closing without impeding the circuit breaker tripping function.

Other objects and features of the present invention will become apparent upon examination of the following specification and claims together with the accompanying drawings.

The objects discussed above are achieved by the switching mechanism of preferred embodiment of the present invention, which is adapted for use with a circuit breaker having a stationary contact and a movable contact mounted on a carrier. The remote control assembly preferably has a motor with a shaft connected to its rotor. The motor is started by a timer switch or other logic switch. The motor shaft protrudes from the motor casing and is fixedly connected to a gear spring, causing the gear spring to rotate simultaneously with the motor rotor. An actuator having a tooth positioned between the coils of the gear spring is moved back and forth as the gear spring rotates clockwise and counterclockwise. An operating rod transfers the movement of the actuator to move the carrier towards the motor and open the contacts. The invention is used here with an overcenter spring mechanism, but may be used with a variety of operating mechanisms, so long as the operating rod moves the carrier partially open in the direction of the blade tripped position. This allows the circuit breaker to trip even when in the open position.

As the actuator moves back and forth along the gear spring causing the circuit breaker contacts to open and close, the actuator also pushes a toggle switch from side to side. The toggle switch is electrically connected to the motor so that upon the circuit breaker contacts opening, the actuator snaps the toggle switch to shut off the motor. When the motor is operated in the reverse direction to close the circuit breaker contacts, the actuator moves along the gear spring in the opposite direction, again flipping the toggle switch to cut off current to the motor as the contacts close.

DETAILED DESCRIPTION OF A PREFERRED EMBODIMENT

Figure 1:
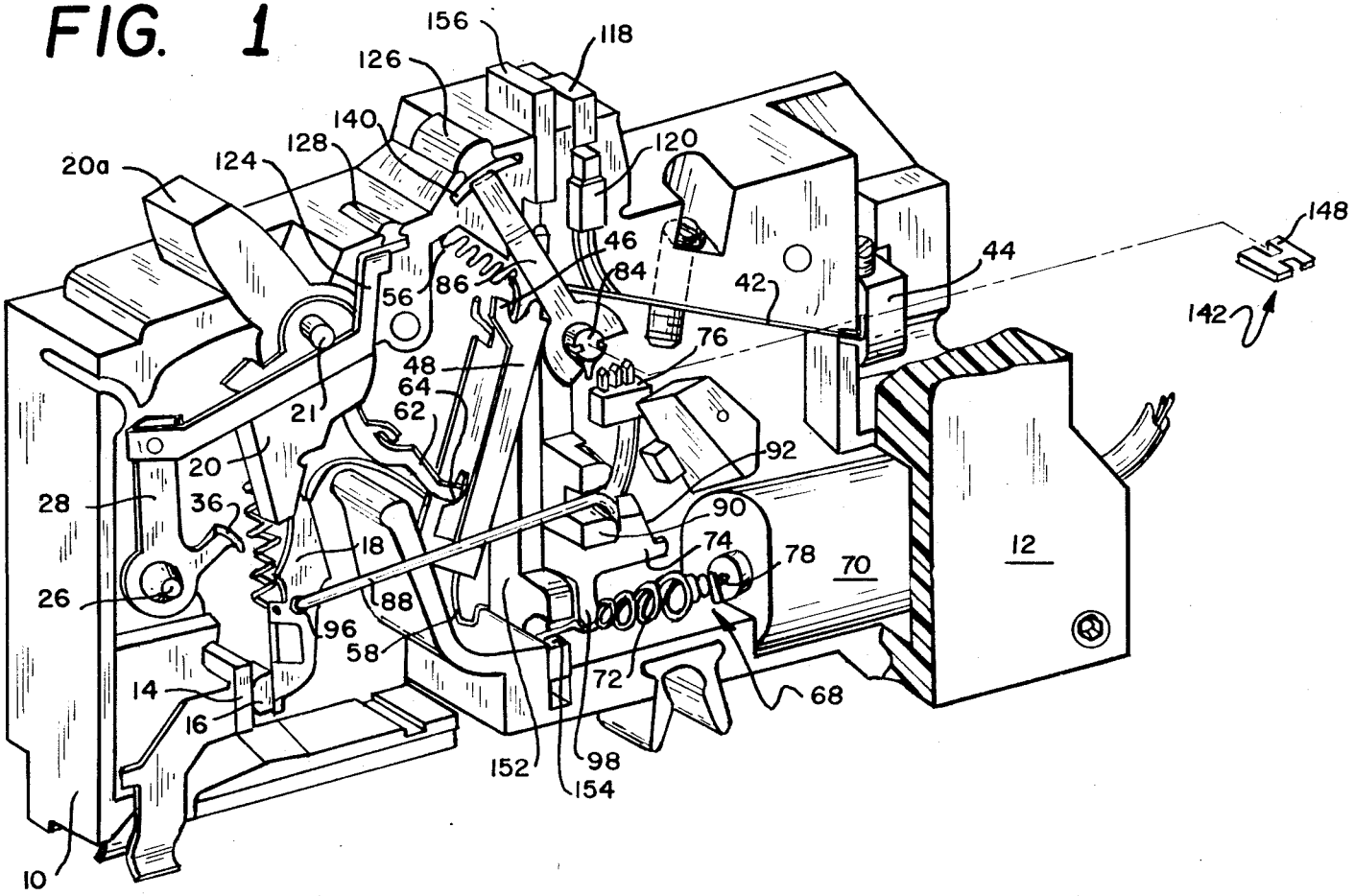
FIG. 1 is a perspective view of the preferred embodiment of subject invention with the majority of the circuit breaker cover cut away, showing the contacts in the closed position.
Figures 2, 5:
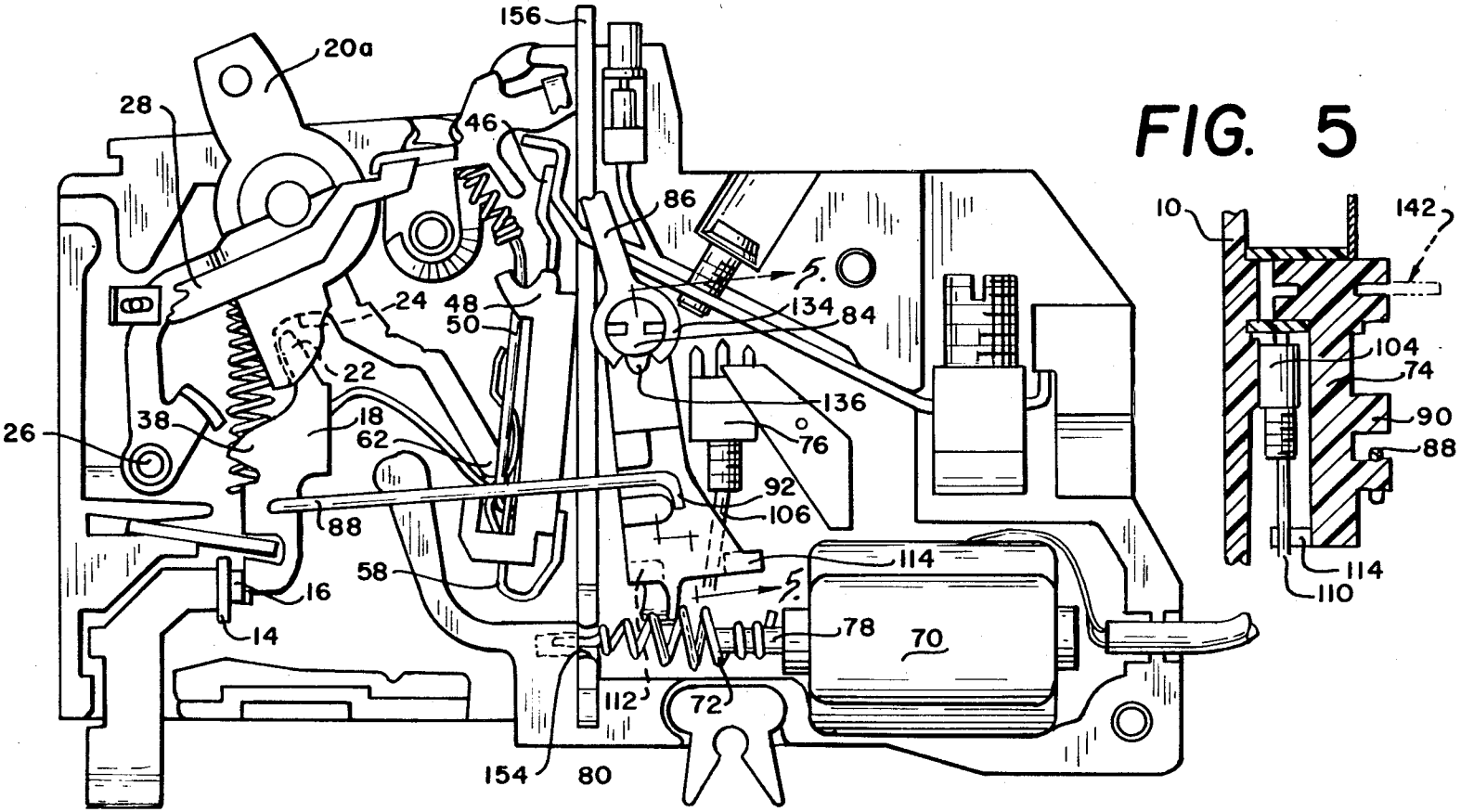
FIG. 2 is a side view of the circuit breaker with the cover removed, showing the circuit breaker in the closed position.
FIG. 5 is a sectional view of the actuator and toggle switch taken along lines 5—5 of FIG. 2.

Referring now to the FIGS. 1 and 2, the preferred embodiment of the circuit breaker with the remote control assembly is shown. The remote control assembly is adapted herein for use with a circuit breaker having an overcenter spring mechanism, such as the one described in detail in U.S. Pat. No. 2,902,560 entitled "Circuit Breaker", issued to H. Stanback, et al on Sept. 1, 1959 and assigned to the same assignee as the present invention. U.S. Pat. No. 2,902,560 is herein incorporated by reference as if set forth fully herein. The pertinent details of that circuit breaker are therefore described here only briefly. As will become apparent later, the present invention may be adapted to switches and circuit breakers having a variety of mechanisms.

The circuit breaker comprises a body or housing 10, of molded insulating material, closed at one face by a detachable cover 12. In the housing 10 are a movable contact 16 that is mounted on a carrier 18 and a stationary contact 14. Pivotally mounted about an axis 21 in the housing 10 is a manual operator 20 having an external operating handle 20*a*. The upper end of the carrier 18 is provided with fingers 22 that are engaged in slots 24 in the manual operator 20 in rocking relation so that the carrier 18 can be rocked clockwise and counterclockwise about its fingers 22 by moving the operating handle 20*a*.

Also pivotally mounted in the housing 10 is a releasably latchable trip lever 28 pivotable about a pin 26 parallel to that of the operator axis 21. The trip lever 28 is connected by a spring 30 to carrier 18. The spring 30 urges the carrier 18 upwardly to seat and hold the upper ends of the fingers 22 in rocking contact with the walls of the slots 24. When the trip lever 28 is released by the circuit breaker trip mechanism, as described below, the spring 30 rocks the trip lever clockwise about pin 26.

The trip mechanism, indicated generally as numeral 40, is connected to a conducting strap 42 connected to a terminal 44. A bimetal 46 is fixedly connected at its upper end to the conducting strap 42. A magnetic yoke 48 is attached to the lower end of the bimetal 46. A movable magnetic armature 50 pivots in arms 52 near the upper end of the yoke 48 and is biased against swinging movement relative to the yoke 48 by an armature spring 56. To adjust the tripping response for a high ambient temperature, a U-shaped bimetal compensator 58 is connected to the lower ends of both the armature 50 and yoke 48. A flexible conductor 60 has one end connected to the bimetal 46 and the other end connected to the carrier 18 to complete the current path through the carrier 18, movable contact 16 and stationary contact 14.

In the circuit breaker closed position, the spring 30 biases the trip lever latch end 62 against the latch seat 64 of the armature 50 and biases the carrier 18 upwards towards the trip lever 28. When the operating handle **20*a* is moved to the right to the open position, the spring 30 moves to the other side of the equilibrium position to snap the carrier 18 upwards and away from the stationary contact 14. As the circuit breaker is manually closed using the operating handle 20*a*, the spring 30 moves in the opposite direction across the equilibrium position, to snap the carrier 18 toward the stationary contact 14** and to close the contacts.

Upon the occurrence of a moderate sustained overload, the bimetal 46 heats up and flexes to the right, as shown in FIG. 2, causing the yoke 48 and armature 50 to swing counterclockwise. This moves the latch seat 64 from under the trip lever latch end 62 and causes the trip lever to swing clockwise. As the trip lever swings clockwise, the spring 30 passes the equilibrium position, pulling the carrier 18 away from the stationary contact 14 to open the contacts. If the contacts have not yet separated, the trip lever actuating portion 36 kicks a shoulder 38 on the carrier 18 to rock the carrier 18 counterclockwise about the upper ends of the fingers 22, providing additional force to separate the contacts. The trip mechanism 40 is reset and the contacts closed by moving the operating handle first to the open position then to the closed position.

Upon the occurrence of an extreme overload, the current through the circuit breaker creates a magnetic force in the yoke 48 that attracts the armature 50, causing it to swing counterclockwise instantaneously. The latch end 62 of the trip lever 28 is released and the circuit breaker is tripped in the manner described above.

The remote control assembly, indicated generally as numeral 68, comprises a motor 70, coil or gear spring 72, actuator 74 and toggle switch 76. The gear spring 72 is solidly connected with the motor shaft 78 by opening by the gear spring 72 and sliding the motor shaft 78 inside. When the gear spring 72 is released, it creates a torsional pressure fit with the motor shaft 78 so that the gear spring rotates simultaneously with the motor. The second end of the gear spring 72 rotates freely within a support 80.

As the actuator 74 rotates about a pivot 84, a position indicator 86 is operated, as will be described later. An operating rod 88, having two bent ends, transfers the movement of the actuator 74 to the carrier 18. The operating rod 88 rests between two raised nubs 90 on the actuator 74, with the first bent end 92 fitting around one of the nubs 90. The second bent end 94 of the operating rod 88 fits within a hole 96 in the carrier 18. The length of the operating rod 88 allows some space between the first end 92 and the nub 90 to accommodate any movement of the carrier towards the stationary contact 14 due to erosion of the contacts.

The actuator 74 has a tooth 98 at its lower end. The tooth 98 moves between the individual wire layers of the gear spring 72 as the gear spring rotates during operation of the motor 70. When the circuit breaker contacts are closed, the actuator tooth 98 is positioned towards the front of the gear spring, or to the left as viewed in FIGS. 1, 2 and 3. As the remote control signal is given to open the circuit breaker, the motor 70 operates and the gear spring 72 rotates clockwise, as viewed from the motor, to move the actuator tooth 98 towards the motor 70.

The movement of the actuator 74 towards the motor causes the operating rod 88 to move the carrier 18 away from the stationary contact 14 to a partial open position. The carrier 18 is moved a distance less than that required to move the spring 30 past the equilibrium position, which would snap the operating handle **20*a* and carrier 18** to the fully open position. Once the contacts are in the fully open position, the circuit breaker cannot be closed from a remote location.

Figure 6:
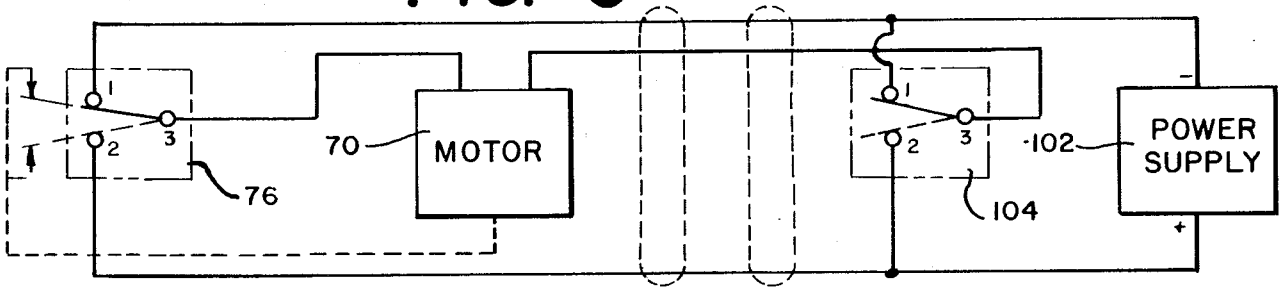
FIG. 6 is a schematic diagram of the electrical control circuit of the of the preferred embodiment.

The circuit breaker contacts may be closed from the partially open position by applying a voltage of opposite polarity to the motor 70. To provide for the alternate application of negative and positive voltages, the motor 70 and switches 76 and 104 are electrically connected as shown in the schematic diagram of FIG. 6. The negative side of a dc power supply 102 is connected concurrently to the first (normally closed or NC) contact of a timer switch 104 and to the first (normally closed NC) contact of a toggle switch 76. The positive side of the power supply 102 is connected concurrently to the second (normally open or NO) contact of both of the timed switch 104 and the toggle switch 76. The common contacts of both the timed switch 104 and the toggle switch 76 are connected to the motor 70.

The position of the toggle switch 76 is controlled by the position of the actuator and corresponds to either the partially open position or the closed position of the contacts. The position of the timer switch 104 is changed by an operator or by a timing device whenever it is desirable to change the position of the contacts independently of the tripping mechanism. When the timer switch 104 and toggle switch 76 are either both in position 1 or both in position 2, as shown in the solid line and dotted line positions of FIG. 6, the motor 70 is off even though current is available from the power supply 102.

With both switches 104 and 76 in position 1, the circuit breaker contacts are closed. When the timer switch 104 is moved to position 2, a voltage drop exists across the motor 70, causing the motor 70 to run and the gear spring 72 to rotate. This moves the actuator 74 to the back of the gear spring 72.

Figure 4:
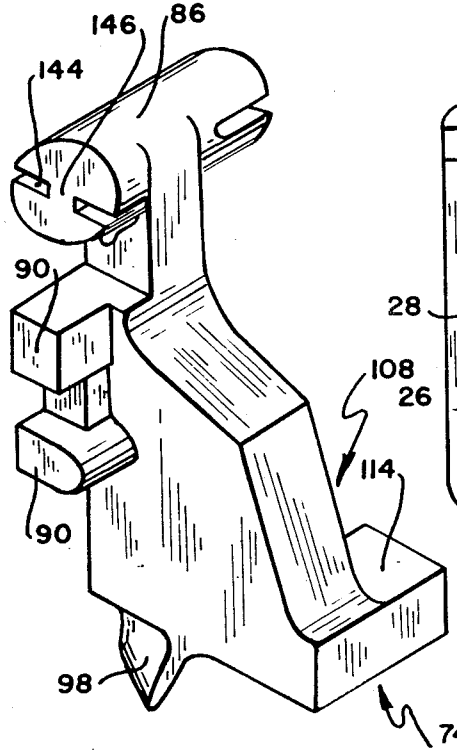
FIG. 4 is a perspective view of the actuator.

As shown in FIG. 4, the actuator 74 includes a cutaway portion 108 surrounding the toggle lever 110 of the toggle switch 76. As the actuator 74 moves toward the motor, the actuator front lobe 112 hits the toggle lever 110, moving the toggle switch 76 to position 2 and cutting off current to the motor 70.

The circuit breaker is closed from a remote location by the timer switch 104 being moved to position 1. A voltage of opposite polarity now exists across the motor 70. The motor 70 runs in the opposite direction until the circuit breaker contacts close and the actuator rear lobe 114 moves the toggle lever 110 back to position 1, shutting off the motor.

The timer switch 104 and toggle switch 76 may be replaced by various other types of switches. The timer switch 104 must be a type of switch having logic capabilities, whether it be a programmable controller or a toggle switch operated by a human. The toggle switch 76 may be replaced by a relay or limit switch, or a variety of other switches. Both switches 104 and 76 may be removed if the power to the motor is limited to an appropriate pulse such as that supplied by a pulse width modulator.

Figure 3:
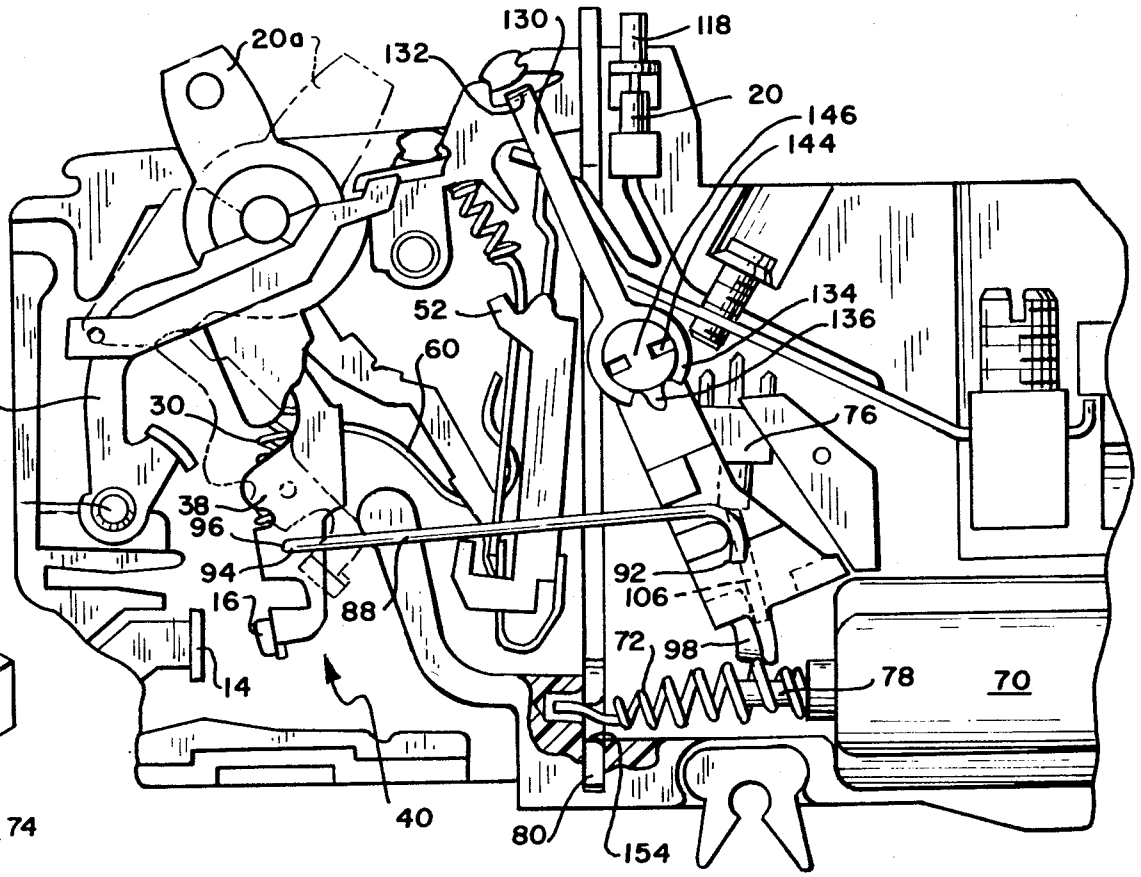
FIG. 3 is a partial side view of the circuit breaker with the cover removed and the contacts opened by the remote control assembly.

After the circuit breaker contacts have been opened by the operation of the remote control assembly 68, the contacts may be closed without control power via the manual override 152. The override 152 is a bar that extends the height of the circuit breaker. The bottom of the override 152 has a bore 154 into which is fitted the end of the coil spring 72. The top 156 of the override extends through the circuit breaker housing. As the override 152 is operated by depressing the override top 156, the override 152 moves down within the circuit breaker housing, bending the gear spring 72 and causing the actuator tooth 98 to slip out of the gear spring 72 and back to the closed closed breaker position, as is shown in FIG. 1. FIG. 3 shows the override 152 depressed just prior to the actuator tooth 98 slipping out of the gear spring 172.

Figure 7:
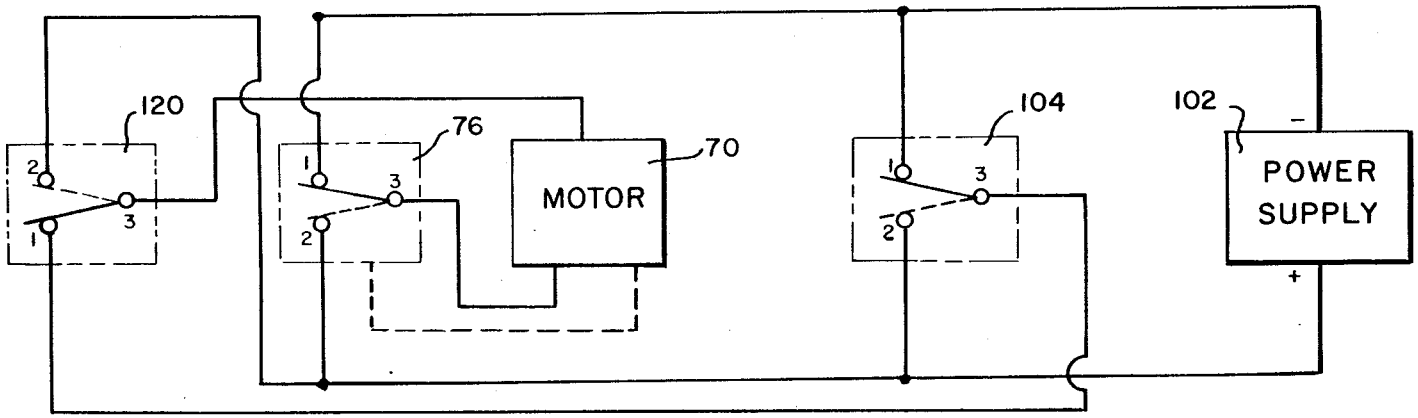
FIG. 7 is a schematic diagram of the electrical control circuit of the remote control assembly including the push to test button.

The remote control assembly may be operated without disturbing the settings of the timer switch 104 by using a test button 118 that operates a test switch 120. The test button 118 of the preferred embodiment is of the push-to-latch type, although other types of switches are also suitable. The control circuit must be modified as shown in FIG. 7, to accommodate the testing function. As with the control circuit of FIG. 6, the negative side of the power supply 102 remains connected to position 1 (NC) of both the timer switch 104 and toggle switch 76, while the positive side of the power supply 102 is still connected to position 2 (NO) of the switches 104 and 76. The common of the toggle switch 76 remains connected to the motor 70, although the common of the timer switch 104 is now connected to position 1 (NC) of an additional test switch 120. Position 2 (NO) of the test switch 120 is connected to the positive side of the power supply 102, while the common of the test switch 120 is connected to the motor 70.

When the circuit breaker contacts are closed, all switches 76, 104 and 120 are normally in position 1. When the timer switch 104 changes positions to open or close the circuit breaker contacts, the timer switch 104 and toggle switch 76 function as described above, while the test switch 120 remains in position 1.

To test the remote control assembly when the circuit breaker contacts are closed, switches 104 and 76 will both be in position 1. When the test button 118 is depressed, the test switch 120 is moved to position 2 and is held there because of the press to latch function of the test button 118. Current is now induced through the motor and the contacts are opened without resetting the timer switch 104. The position indicator 86 will be visible through the plate 126 if the remote control assembly is operating properly, as will be described later.

To return the circuit breaker to the "on" position, the test button 118 is released, returning the test switch 120 to position 1. Since the toggle switch 76 is now in position 2, the motor 70 runs in the opposite direction to return the toggle switch 76 to position 1.

The position indicator 86 operates independently of the trip indicator 124, with the two indicators being viewed through separate plexiglass plates, 126 and 128 respectively, in the circuit breaker housing 10. The position indicator 86 includes an approximately straight portion 130 with a perpendicular finger 132 at one end and a partial ring 134 at the other end. The partial ring 134 fits around the actuator pivot 84, with a foot 136 on the pivot 84 occupying a portion of the opening of the partial ring 134. The partial ring 134 is positioned to hit the foot 136 when the circuit breaker is remotely opened to move the finger 132 behind the clear plate 126. Upon the circuit breaker being closed, the foot 136 hits the other side of the partial ring 134 to move the finger 132 within a slot 140 in the housing where it is not visible from outside the circuit breaker.

The preferred embodiment of the present invention has been described above with reference to a single pole circuit breaker. The design may be easily adapted for a multi-pole circuit breaker to be opened and closed simultaneously from a remote location. For a two-pole circuit breaker, two single pole circuit breakers, as described above, are joined side-by-side. The second circuit breaker is modified to omit the motor 70 and gear spring 72. An H-shaped pole connector 142 is fitted between the channels 144 of the actuator pivots 84 of the two poles. Each channel has a tab 146 in its center. The tab 146 is dimensioned to fit snugly between the legs 148 of the pole connector 142. As the motor 70 of the first pole operates to rotate the actuator 74, the pivot 84 of the first pole rotates. The pole connector 142 transfers the rotation of the first pole pivot 84 to the second pole pivot 84, moving the actuator 74 away from the trip mechanism and opening the contacts 14 and 16 of the second pole. The closing of the first pole contacts via the remote control assembly closes the second pole contacts in a similar manner. Since the actuator 74 of the first pole moves before the actuator 74 of the second pole, the operating rod of the second pole is shortened a small amount so that the contacts of both poles open simultaneously.

While the invention has particularly been shown and described with reference to a preferred embodiment, it will be understood by those skilled in the art that variations in form, construction and arrangements may be made therein without departing from the spirit and scope of the invention. All such variations are intended to be covered in the appended claims.

We claim:

1. A switch for connection to a circuit for remote opening and closing of the circuit, said switch comprising:

a first contact;

a second contact having a closed position wherein said second contact touches said first contact, said second contact having an open position wherein said second contact is positioned a distance from said first contact, said second contact being movable between the closed position and the open position;

a carrier connected to said second contact for moving said second contact between the closed position and the open position;

an operating handle connected to said carrier, said handle being manually movable to cause said carrier to move said second contact between the closed position and the open position;

a motor activated by a signal received from a remote location, said motor having a shaft that rotates upon the motor being activated; and transfer means for transferring the motor shaft rotation to cause said carrier to move said second contact between the closed position and the open position independently of the movement of said handle.

2. A switch as claimed in claim 1 additionally comprising a trip mechanism connected to said second contact to move said second contact to the open position upon the occurrence of an overcurrent, said trip mechanism operating independently of said motor.

3. A switch as claimed in claim 1 wherein said transfer means comprises a helix connected to said motor shaft to rotate in response to said motor activation; and an actuator connected to said helix and connected to said second contact to move said second contact in response to the rotation of said helix.

4. A switch as claimed in claim 3 additionally comprising a switch mechanically connected to said actuator and electrically connected to said motor, said switch deactivating said motor in response to the movement of said actuator.

5. A switch as claimed in claim 3 wherein said actuator rotates about a pivot in response to the rotation of said helix.

6. A circuit breaker comprising:

a first contact;

a movable contact having an open position and a closed position, wherein in the open position said movable contact is a distance away from said first contact, and in the closed position said movable contact is in contact with said first contact, said movable contact being movable between the open position and the closed position;

a trip mechanism connected with said movable contact to move said movable contact to the open position upon the occurrence of an overcurrent through the circuit breaker;

a motor operating upon receiving a signal from a remote location;

and remote transfer means connected to said motor and to said movable contact for moving said movable contact between the open position and the closed position upon the activation of said motor, wherein said movable contact is farther from said first contact when in the open position as a result of said trip mechanism operation than when in the open position as a result of said remote transfer means operation.

7. A circuit breaker as claimed in claim 6 wherein said motor operates in a first direction to move the movable contact to the open position upon receiving a first signal from a remote location and said motor operates in a second direction upon receiving a second signal from a remote location to move the movable contact to the closed position.

8. A circuit breaker as claimed in claim 6 additionally comprising a switch electrically connected to said motor and mechanically connected to said movable contact, wherein said switch shuts off said motor upon said movable contact reaching the open position.

9. A circuit breaker as claimed in claim 6 also comprising a shaft extending from said motor, wherein said remote transfer means comprises an operating rod connected to said movable contact and to said motor shaft.

10. A circuit breaker as claimed in claim 9 wherein said motor shaft comprises a helical element.

11. A circuit breaker as claimed in claim 10 wherein said helical element is a coil rotating simultaneously with the operation of the motor.

12. A circuit breaker comprising:

a first contact;

a movable contact having an open position and a closed position, wherein in the open position said movable contact is a distance away from said first contact, and in the closed position said movable contact is in contact with said first contact, said movable contact being movable between the open position and the closed position;

a trip mechanism connected with said movable contact to move said movable contact to the open position upon the occurrence of an overcurrent through the circuit breaker;

a motor operating in a first direction upon receiving a first signal from a remote location;

a shaft extending from said motor, said shaft comprising a coil rotating simultaneously with said motor;

an operating rod connected to said motor shaft and to said movable contact for moving said movable contact to the open position upon the activation of said motor;

and an override element including a seat for said coil, whereupon said coil releases said operating rod to allow said movable contact to return to the closed position in response to said movable contact being held open by said operating rod and said override element being operated.

13. A circuit breaker as claimed in claim 11 wherein said coil is connected to said motor shaft by a torsional fit.

14. A circuit breaker comprising:

a first contact;

a movable contact having an open position and a closed position, wherein in the open position said movable contact is a distance away from said first contact, and in the closed position said movable contact is in contact with said first contact, said movable contact being movable between the open position and the closed position;

a trip mechanism connected with said movable contact to move said movable contact to the open position upon the occurrence of an overcurrent through the circuit breaker;

a motor having a shaft, said motor operating upon receiving a signal from a remote location;

and an operating rod connected with said movable contact and with said motor shaft, said operating rod moving in a direction approximately parallel to said motor shaft to move said movable contact between the open position and the closed position.

15. A circuit breaker as claimed in claim 14 wherein said motor shaft comprises a helical element.

16. A circuit breaker as claimed in claim 15 wherein said helical element is a coil rotating simultaneously with the operation of the motor.

17. A circuit breaker as claimed in claim 14 wherein the movable contact is farther from the first contact when in the open position as a result of the trip mechanism operation than when in the open position as a result of the remote transfer means operation.

* * * * *

UNITED STATES PATENT AND TRADEMARK OFFICE

CERTIFICATE OF CORRECTION

PATENT NO. : 4,623,859

DATED : November 18, 1986

INVENTOR(S) : Kenneth W. Erickson; John H. Gilliland

It is certified that error appears in the above—identified patent and that said Letters Patent is hereby corrected as shown below:

Front page, Item [75] should read:

[75] Inventors: Kenneth W. Erickson,
John H. Gilliland, both of Lincoln, Nebraska
Robert E. Hart, Raleigh, North Carolina
David W. Kreider, Deceased, formerly of Clearwater, Florida

Signed and Sealed this

Seventh Day of April, 1987

*Attest:*

DONALD J. QUIGG

*Attesting Officer*

*Commissioner of Patents and Trademarks*